US006117005A

United States Patent [19]

Weiss

[11] Patent Number: 6,117,005

[45] Date of Patent: Sep. 12, 2000

[54] AIR CONDITIONING EXTENDER SYSTEM

[76] Inventor: Peter T. Weiss, 208 Mayfield Ave., Valparaiso, Ind. 46383

[21] Appl. No.: 09/204,474

[22] Filed: Dec. 3, 1998

[51] Int. Cl.[7] ..... F24F 7/06

[52] U.S. Cl. ..... 454/202; 454/306

[58] Field of Search ..... 454/201, 202, 454/306; 138/DIG. 4; 34/97

[56] References Cited

U.S. PATENT DOCUMENTS

| | | | |
|---|---|---|---|
| 2,824,575 | 2/1958 | Rosen | 454/306 X |
| 2,960,924 | 11/1960 | Grott | 454/202 |
| 4,146,933 | 4/1979 | Jenkins et al. . | |
| 4,315,457 | 2/1982 | Lang et al. | 454/306 |
| 4,900,342 | 2/1990 | Spengler . | |
| 5,036,601 | 8/1991 | Mulle, Jr. et al. | 34/97 |
| 5,173,094 | 12/1992 | Brady . | |
| 5,649,860 | 7/1997 | Giuffrida | 454/306 |
| 5,655,963 | 8/1997 | Paschke et al. | 454/306 X |
| 5,769,708 | 6/1998 | Paschke | 454/306 |

*Primary Examiner*—Harold Joyce

[57] ABSTRACT

An air conditioning extender system including a flexible, air-impermeable tube fabricated of plastic. The tube has an input end and an output end and a circumference essentially equal to the circumference of the air conditioner output duct. The tube has a length at least several times greater than that of the circumference of the output duct and tube. A plurality of axial slits extend from the input end of the tube with a plurality of lengths of a first pile-type fastener secured thereto between the slits. The slits are adapted to releasably couple to a plurality of lengths of a second pile-type fastener secured to the circumference of the output duct.

7 Claims, 2 Drawing Sheets

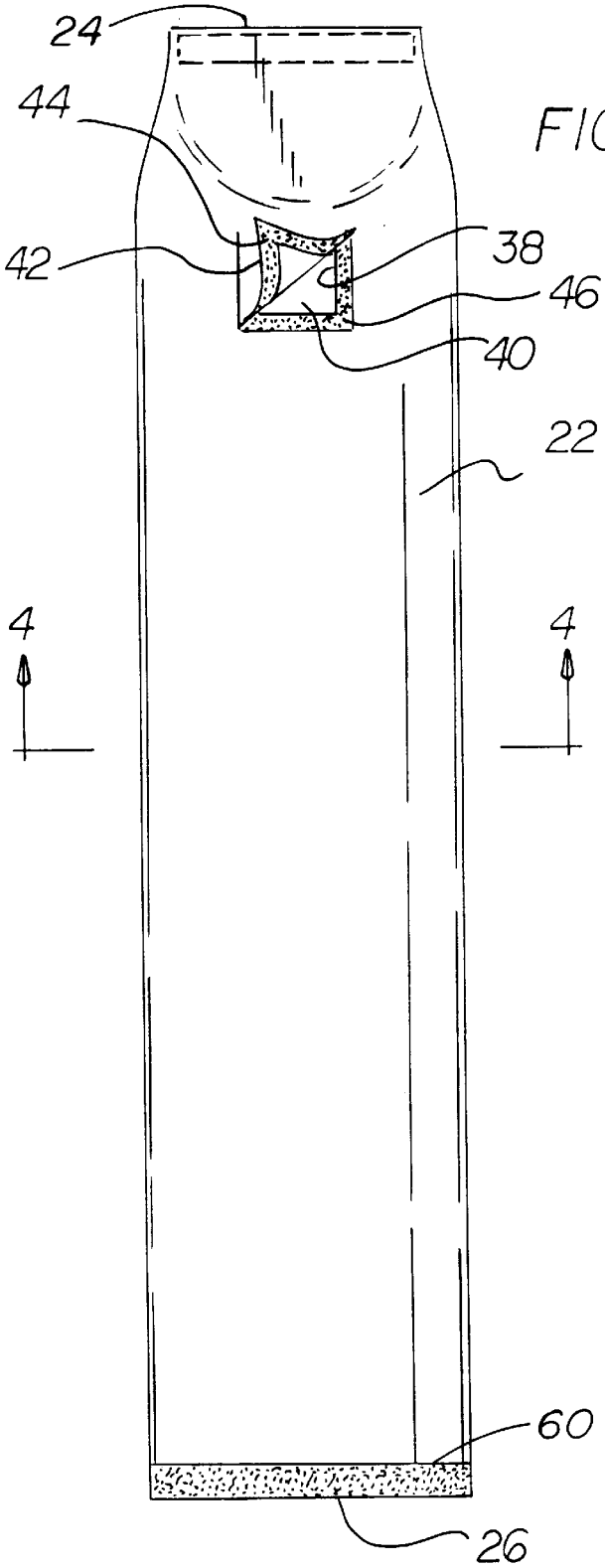
FIG 3
FIG 4
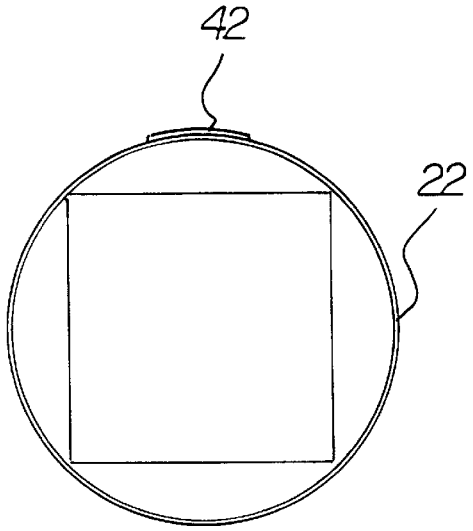
FIG 5
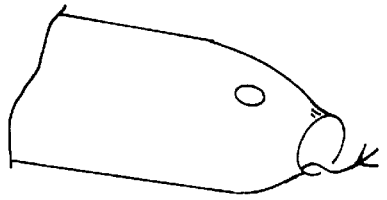

AIR CONDITIONING EXTENDER SYSTEM

BACKGROUND OF THE INVENTION

1. Field of the Invention

The present invention relates to a air conditioning extender system and more particularly pertains to conveying cool conditioned air from an air conditioner to a remote location.

2. Description of the Prior Art

The use of air conditioner accessories of known designs and configurations is known in the prior art. More specifically, air conditioner accessories of known designs and configurations heretofore devised and utilized for the purpose of cooling air at various locations through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,133,579 to Anderson et al. discloses an Extendible-Contractible, Flexible, Helical Conduit and Coupling Assembly. U.S. Pat. No. 4,628,799 to Lang et al. discloses a Duct Attachment and Extension for an Air Conditioning Unit. U.S. Pat. No. 4,315,457 to Lang et al. discloses a Duct Attachment Means for An Air Conditioning Unit. U.S. Pat. No. 4,020,753 to Efstratis discloses a Ventilation Extension Unit. U.S. Pat. No. 3,225,679 to Meyer discloses an Air Deflector. Lastly, U.S. Pat. No. 3,359,883 to Murphy discloses a Seating Duct Attachment.

In this respect, the air conditioning extender system according to the present invention substantially departs from the conventional concepts and designs of the prior art, and in doing so provides an apparatus primarily developed for the purpose of conveying cool conditioned air from an air conditioner to a remote location.

Therefore, it can be appreciated that there exists a continuing need for a new and improved air conditioning extender system which can be used for conveying cool conditioned air from an air conditioner to a remote location. In this regard, the present invention substantially fulfills this need.

SUMMARY OF THE INVENTION

In view of the foregoing disadvantages inherent in the known types of air conditioner accessories of known designs and configurations now present in the prior art, the present invention provides an improved air conditioning extender system. As such, the general purpose of the present invention, which will be described subsequently in greater detail, is to provide a new and improved air conditioning extender system and method which has all the advantages of the prior art and none of the disadvantages.

To attain this, the present invention essentially comprises a new and improved air conditioning extender system for conveying cool conditioned air from an air conditioner to a remote location. The system includes an air conditioner which has an input duct to receive air from a room to be conditioned and an output duct to dispense conditioned air into a room. The output duct has a fixed circumference and controls. The system also includes a flexible, air-impermeable tube fabricated of polyethylene having a thickness of about 0.95 mils. The tube has an input end and an output end with a circumference essentially equal to the circumference of the air conditioner output duct and a length at least several times greater than that of the circumference of the output duct and tube. Four short axial slits are provided and extend from the input end of the tube with four lengths of a first pile-type fastener secured between the slits and adapted to releasably couple to four lengths of a second pile-type fastener secured to the circumference of the output duct. A U-shaped slit is provided in the tube between the input end and the output ends forming a rectangular opening with a rectangular flap secured on one end and selectively positionable to open and close the opening and with a third pile-type fastener on the flap and a fourth pile-type fastener on the tube around the opening for securing the flap in a closed position. Lastly provided is a closure at the output end of the tube in a generally circular configuration.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air conditioning extender system which has all of the advantages of the prior art air conditioner accessories of known designs and configurations and none of the disadvantages.

It is another object of the present invention to provide a new and improved air conditioning extender system which may be easily and efficiently manufactured and marketed.

It is further object of the present invention to provide a new and improved air conditioning extender system which is of durable and reliable constructions.

An even further object of the present invention is to provide a new and improved air conditioning extender system which is susceptible of a low cost of manufacture with regard to both materials and labor, and which accordingly is then susceptible of low prices of sale to the consuming public, thereby making such air conditioning extender system economically available to the buying public.

Even still another object of the present invention is to provide a air conditioning extender system for conveying cool conditioned air from an air conditioner to a remote location.

Lastly, it is an object of the present invention to provide a new and improved an air conditioning extender system including a flexible, air-impermeable tube fabricated of plastic. The tube has an input end and an output end and a circumference essentially equal to the circumference of the air conditioner output duct. The tube has a length at least several times greater than that of the circumference of the output duct and tube. A plurality of axial slits extend from the input end of the tube with a plurality of lengths of a first pile-type fastener secured thereto between the slits. The slits are adapted to releasably couple to a plurality of lengths of a second pile-type fastener secured to the circumference of the output duct.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view of the tube of the prior Figures.

FIG. 4 is a cross-sectional view taken along line 4-4 of FIG. 3.

FIG. 5 is a partial side view of the free end of the present invention having a pair of eye members and a tongue member coupled thereto to represent a serpent's head.

The same reference numerals refer to the same parts through the various Figures.

DESCRIPTION OF THE PREFERRED EMBODIMENT

Figure 1:
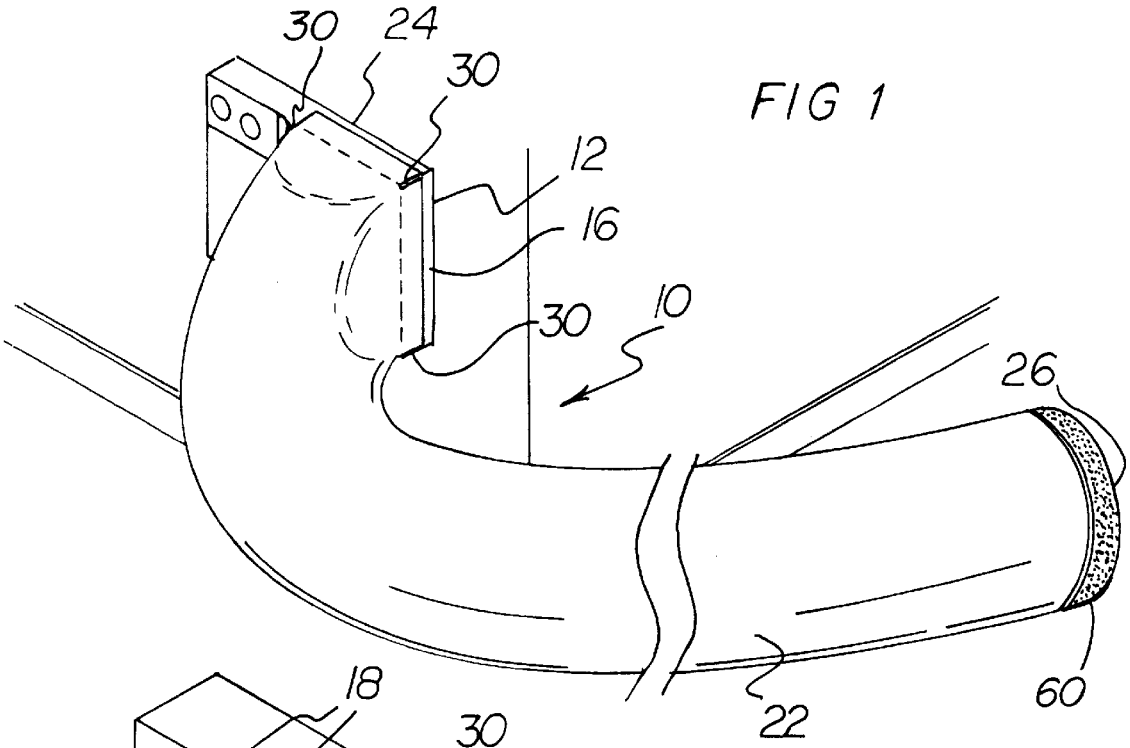
FIG. 1 is a perspective view of the preferred embodiment of the air conditioning extender system constructed in accordance with the principles of the present invention.
Figure 2:
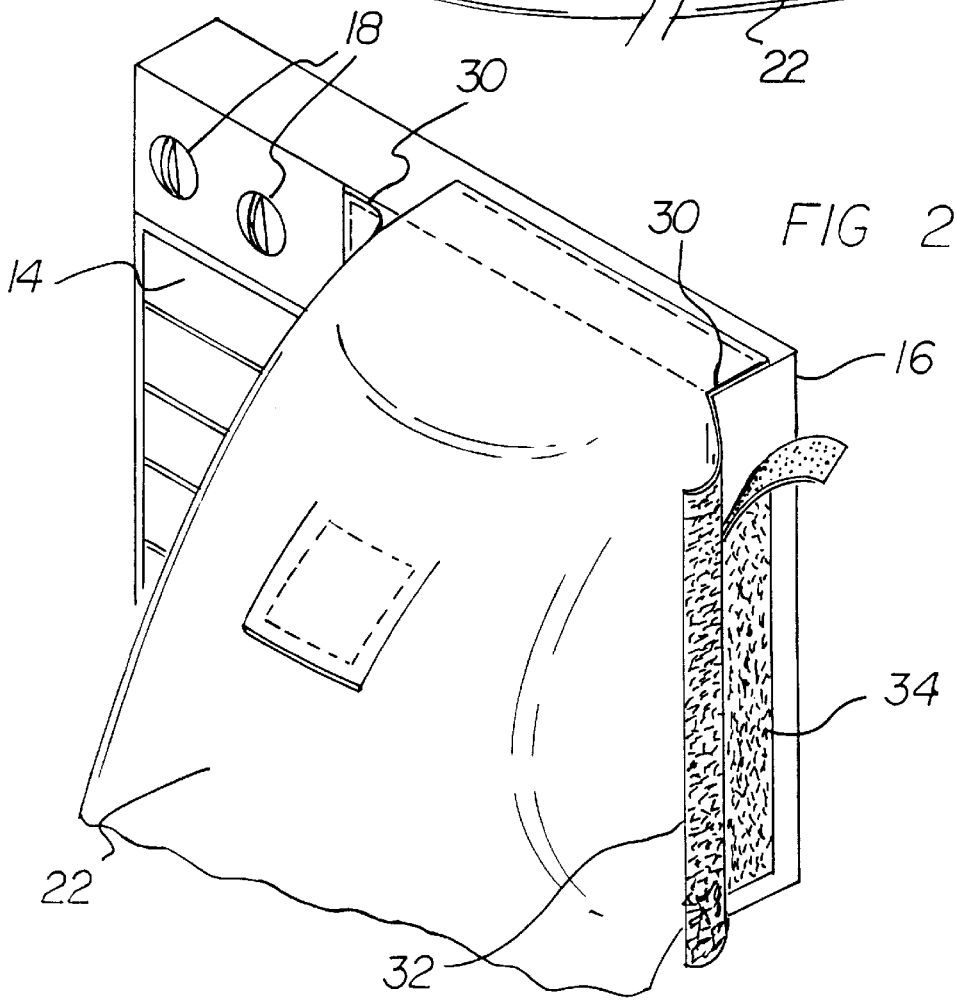
FIG. 2 is an enlarged perspective view of the coupling between the tube and air conditioner with parts removed to show certain internal constructions thereof.

With reference now to the drawings, and in particular to FIG. 1 thereof, the preferred embodiment of the new and improved air conditioning extender system embodying the principles and concepts of the present invention and generally designated by the reference numeral 10 will be described.

The present invention, the air conditioning extender system 10 is comprised of a plurality of components. Such components are individually configured and correlated with respect to each other so as to attain the desired objective.

More specifically, the new and improved air conditioning extender system 10 for conveying cool conditioned air from an air conditioner to a remote location comprises an air conditioner 12 having an input duct 14 to receive air from a room to be conditioned and an output duct 16 to dispense conditioned air into a room. The output duct having a fixed circumference and with associated controls 18 therefor.

Also provided is a flexible, air-impermeable tube 22 fabricated of polyethylene having a thickness of about 0.95 mils. The tube has an input end 24 and an output end 26 with a circumference essentially equal to the circumference of the air conditioner output duct and a length at least several times greater than that of the circumference of the output duct and tube. In an illustrative ideal embodiment, the tube may be constructed having a length of about, 6, 8, and 10 feet depending on the needs of the user. In this ideal embodiment, the diameter of the tube is ideally about 3 feet 5 inches.

Further provided are four short axial slits 30 extending from the input end of the tube with four lengths of a first pile-type fastener 32 secured thereto between the slits and adapted to releasably couple to four lengths of a second pile-type fastener 34 secured to the circumference of the output duct.

A U-shaped slit 38 formed in the tube between the input end and the output ends forming a rectangular opening 40 with a rectangular flap 42 secured on one end and selectively positionable to open and close the opening and with a third pile-type fastener 44 on the flap and a fourth pile-type fastener 46 on the tube around the opening for securing the flap in a closed position; and Optionally, an annular strip of a hook and loop fastener 60 may be provided around the output end of the tube to permit attachment of another tube to the output end to increase the overall length of the system.

Optionally, a closure may be provided at the output end of the tube in a generally circular configuration to substantially close the output end of the tube.

The system of the present invention as described hereinabove consists of an approximately 3 foot diameter, 0.95 mil thick, flexible plastic tubing section. One end simply features a full diameter opening, while the other end features a similar opening, the circumference of which is lined with the one portion of a hook and loop fastener strip. The other portion of this strip features a pressure-sensitive adhesive backing that permits it to be applied to the outlet vent of the air condition in question. Located a short distance from this end at a point on the outer wall of this tube is a short slit that is also equipped with a hook and a loop fastener style closure. In use, it serves as an adjustable vent that enables cooled air to be transferred into the room in which the air condition in question is installed.

This product is potentially producible in a range of colors, including various multi-color patterns. Novelty units are produced with imprints to resemble a snake, worm, caterpillar, or related creature, with the outlet and imprinted to resemble the head.

The appealing features of the present system are it simplicity, ease of installation and use, and the comfort and energy-savings it provides. This product temporarily changes the area of coverage capable of being provided by a conventional window or through-the-wall air conditioner. For example, it enables a bedroom to be cooled in the evening by an air conditioner located in a living room. It could be initially installed in a matter of minutes and without any tools. Once installed, it could be removed and reattached in a matter of seconds.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A air conditioning extender system for conveying cool conditioned air from an air conditioner to a remote location comprising, in combination:

an air conditioner having an input duct to receive air from a room to be conditioned and an output duct to dispense conditioned air into a room, the output duct having a fixed circumference and with associated controls therefor;

a flexible, air-impermeable tube fabricated of polyethylene having a thickness of about 0.95 mils, the tube having an input end and an output end with a circumference essentially equal to the circumference of the air conditioner output duct and a length at least several times greater than that of the circumference of the output duct and tube;

four short axial slits extending from the input end of the tube with four lengths of a first pile-type fastener secured thereto between the slits and adapted to releasably couple to four lengths of a second pile-type fastener secured to the circumference of the output duct;

a U-shaped slit formed in the tube between the input end and the output ends forming a rectangular opening with a rectangular flap secured on one end and selectively positionable to open and close the opening and with a third pile-type fastener on the flap and a fourth pile-type fastener on the tube around the opening for securing the flap in a closed position; and a closure at the output end of the tube in a generally circular configuration.

2. An air conditioning extender system comprising:

a flexible, air-impermeable tube fabricated of plastic, the tube having an input end and an output end with a circumference essentially equal to the circumference of an air conditioner output duct and a length at least several times greater than that of the circumference of the output duct and tube;

a plurality of axial slits extending from the input end of the tube with a plurality of lengths of a first pile-type fastener secured thereto between the slits and adapted to releasably couple to a plurality of lengths of a second pile-type fastener secured to the circumference of the output duct; and a U-shaped slit formed in the tube between the input end and the output ends forming a rectangular opening with a rectangular flap secured on one end and selectively positionable to open and close the opening and with a third pile-type fastener on the flap and a fourth pile-type fastener on the tube around the opening for securing the flap in a closed position.

3. The system as claimed in claim 2 and further including an air conditioner having an input duct to receive air from a room to be conditioned and an output duct to dispense conditioned air into a room, the output duct having a fixed circumference and with associated controls therefor.

4. The system as claimed in claim 2 and further including a closure at the output end of the tube in a generally circular configuration.

5. The system of claim 2, wherein the tube has a length and a diameter, wherein the length of the tube is greater than twice the diameter of the tube.

6. The system of claim 2, wherein the tube has a length and a diameter, wherein the length of the tube at least about 6 feet and the diameter of the tube is about 41 inches.

7. The system of claim 2, wherein the tube has a length defined between the input and output ends of the tube, wherein each of the axial slits has a length, wherein the lengths of the axial slit are generally equal to one another, wherein the length of each axial slit is less than one-fourth the length of the tube.

* * * * *